United States Patent [19]

Newel-Lewis

[11] Patent Number: 4,705,182

[45] Date of Patent: Nov. 10, 1987

[54] INDICATOR DEVICE

[75] Inventor: Jan Newel-Lewis, London, England

[73] Assignee: Alternate Resources PLC, United Kingdom

[21] Appl. No.: 900,785

[22] Filed: Aug. 27, 1986

[30] Foreign Application Priority Data

Aug. 29, 1985 [GB] United Kingdom ..... 21476

[51] Int. Cl.[4] ..... B65D 55/12

[52] U.S. Cl. ..... 215/230; 116/308; 206/534; 222/23

[58] Field of Search ..... 116/308; 206/534, 540; 215/230; 222/23

[56] References Cited

U.S. PATENT DOCUMENTS

| | | | |
|---|---|---|---|
| 3,678,884 | 7/1972 | Robbins | 116/308 |
| 4,444,328 | 4/1984 | Glass | 215/230 |
| 4,489,834 | 12/1984 | Thackrey | 116/308 X |
| 4,528,933 | 7/1985 | Allen | 206/534 X |

*Primary Examiner*—Donald F. Norton

*Attorney, Agent, or Firm*—Cesari and McKenna

[57] ABSTRACT

An indicator device for a table dispenser has a first cylindrical rotatable member defining an aperture, a second cylindrical rotatable member arranged concentrically with respect to the first member, a third cylindrical member relatively fixed with respect to and concentric with the first and second members, means coupling the first and second members for rotation together in a first direction of rotation from a first position of the first member in which access through the aperture is not possible to a second position of the first member in which access through the aperture is possible for dispensing a tablet, means coupling the second and third members to prevent the rotation of the second member in the direction of rotation opposite to the first direction during the rotation of the first member from the second position to the first position and means to indicate, upon the restoration of the first member to its first position after it has been rotated to the second position, the time that a tablet is next due to be dispensed.

5 Claims, 5 Drawing Figures

INDICATOR DEVICE

This invention relates to an indicator device. An embodiment of the invention will be described below, by way of example, with reference to a cap for a bottle which incorporates means which, upon dispensing a dose in the form of a tablet or tablets from the bottle, provides a visual indication relating to a successive dose. It will be appreciated that the indicator may be used in other ways than with a bottle, or with tablets.

Figure 1:
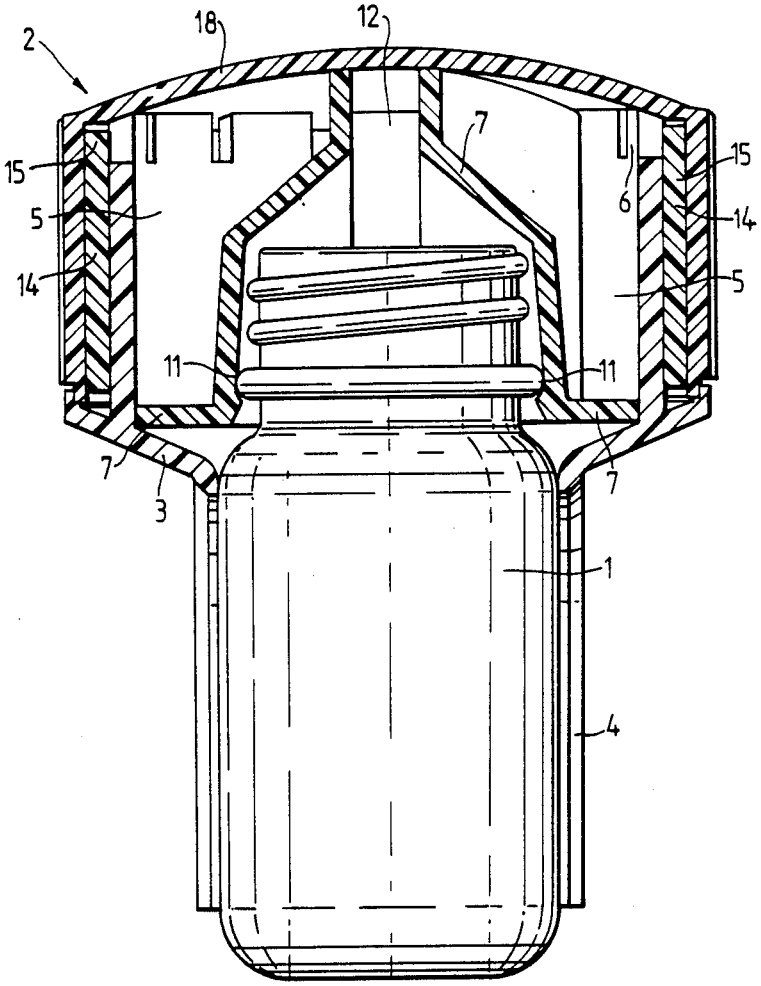
Figure 2:
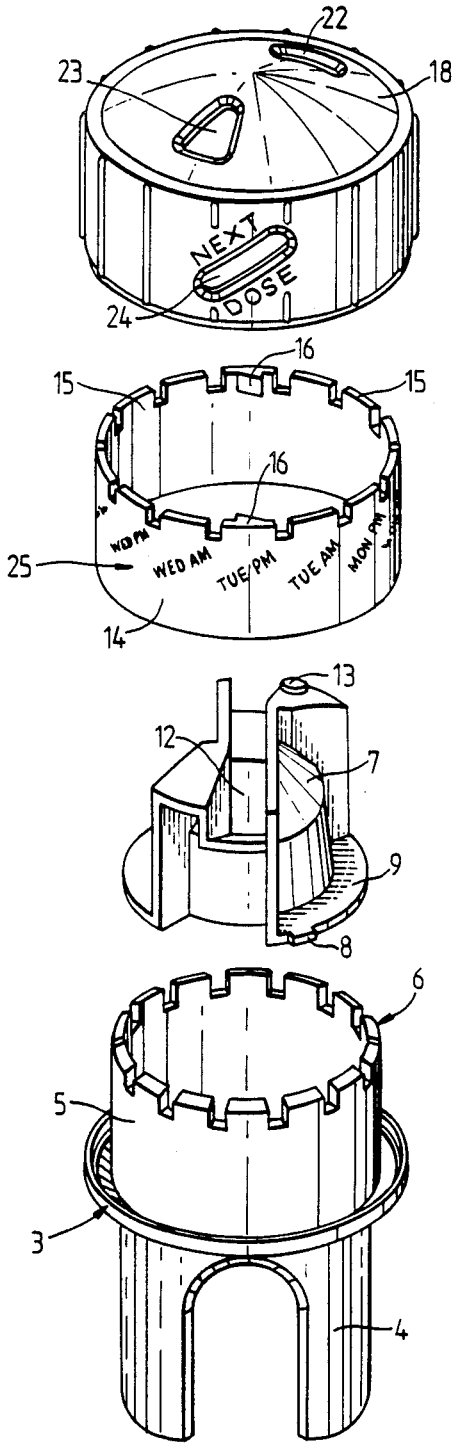
Figure 3:
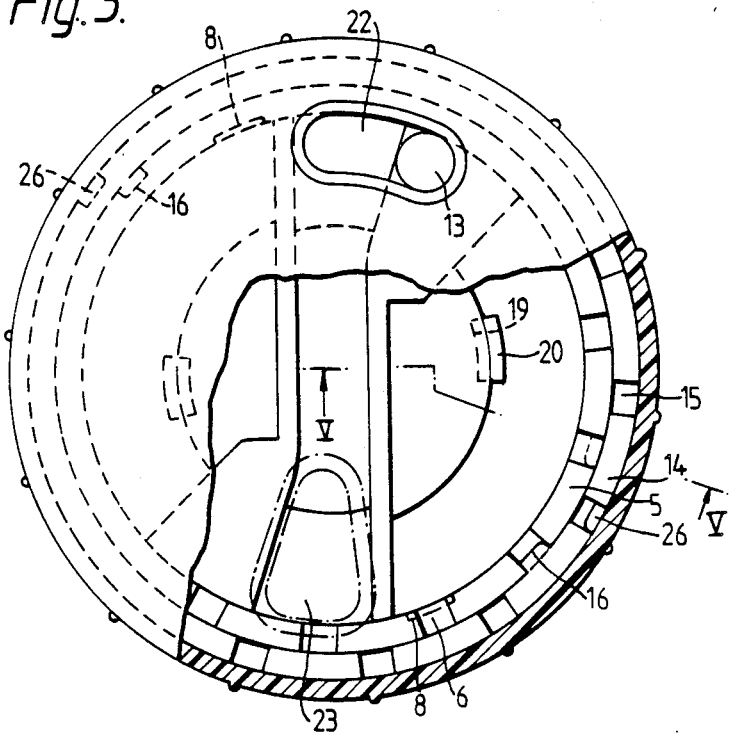
Figure 4:
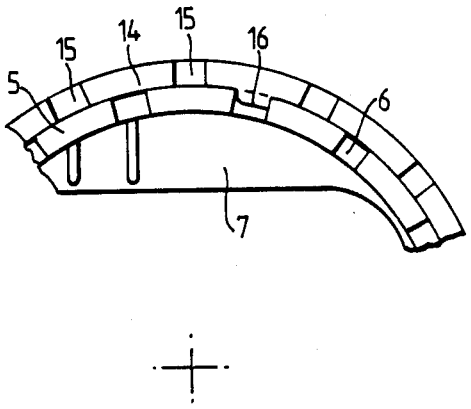
Figure 5:
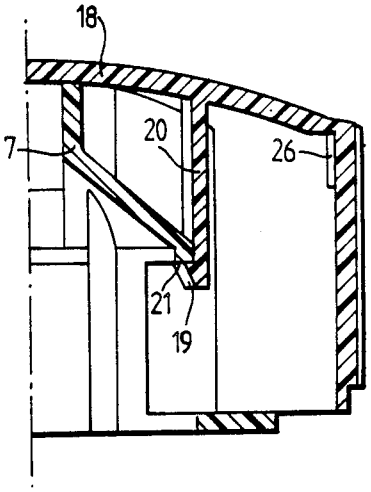

An embodiment of the invention will now be described, by way of example, with reference to the accompanying drawings in which FIG. 1 is a vertical section through a cap arranged upon a bottle, FIG. 2 is an exploded perspective view of the parts of the cap shown in FIG. 1, FIG. 3 is a partly cut-away plan view of the cap, FIG. 4 is a plan view of a part of the cap and FIG. 5 is a vertical section on the line V—V of FIG. 3.

Referring to the drawings and particularly to FIGS. 1 and 2, there are shown a bottle 1, and a cap indicated generally at 2 and including a main body 3 which has a lower skirt portion 4, shaped to fit like a shroud upon the body of a standard bottle, and an upper portion 5 of circular cross-section which has a castellated upper rim 6 which acts, in operation, as a ratchet. The cap also includes a retainer insert 7, which slides into the main body 3 via the upper portion 5. The insert 7 has two small lugs 8, one of which is visible in FIG. 2, extending from a ring 9 at the base of the insert 7. The lugs 8 locate under two catches in the main body 3, in order to retain the insert in the correct position and orientation with respect to the main body. The insert 7 grips the neck of the bottle 1, as indicated at 11 and incorporates a hopper 12 through which pills may pass as they leave the bottle 1. A small round lug 13 on the top of the retainer insert 7 co-operates with an arcuate slot to be described in a cover.

A cylindrical sleeve 14, having a castellated upper rim 15, fits over the upper portion 5 of the main body 3. The castellations in the upper rim 15 correspond to those in the upper rim 6 of the portion 5 of the main body 3. On the inner face of the sleeve 14 there are two pawls 16 which cooperate with the ratchet formed by the castellated upper rim 6 of the upper portion 5 of the main body 3.

A cover 18, referred to briefly above, is placed on top of the assembly and lugs 19 carried on arms 20 extending from the roof of the cover 18 clip on to respective ledges 21 on the retainer insert 7.

The cover 18 incorporates an arcuate slot 22 through which the lug 13 on the retainer insert 7 projects, an outlet aperture 23 through which pills may be dispensed from the bottle 1 and a window 24 set at an angle corresponding to that of wording indicated at 25 on the outer face of the cylindrical sleeve 14.

The cover 18 may be rotated relative to the remainder of the cap by an amount which is limited by the lug 13 which projects through the arcuate slot 22 and against which the ends of the slot 22 strike. In the particular embodiment being described, the limited rotational movement is 1/14th of a turn anti-clockwise to open the cap and 1/14th of a turn clockwise to close the outlet aperture 23 of the cap.

Within the cover 18, there is an inwardly projecting pawl 26 which cooperates with the castellations 15 of the sleeve 14. As mentioned above, the sleeve 14 also has inwardly projecting pawls 16 which cooperate with the castellated upper rim 6 of the portion 5 of the main body 3.

In operation, rotation of the cover 18 in the anti-clockwise direction until the lug 13 strikes one end of the arcuate slot 22, as illustrated in FIG. 3, results in the outlet aperture 23 being brought into line with the hopper 12 in the retainer insert 7. In this position, it is possible to shake a tablet or tablets from the bottle via the hopper 12 and out of the aperture 23.

At the same time, by virtue of the engagement of the pawl 26 in the upper castellated rim 15 of the sleeve 14, the anti-clockwise rotation of the cover 18 causes the sleeve 14 to be rotated in the anti-clockwise direction. In this direction of rotation, the pawls 16 are able to pass from the space between one castellation and the reset. The wording indicated at 25 is thus rotated by 1/14th of a turn in the anti-clockwise direction. Upon the rotation of the cover 18 in the clockwise direction until the lug 13 strikes the other end of the slot 22, the sleeve 14 is restrained against rotation by the engagement of the pawls 16 in the castellations 6 on the upper portion 5 of the main body 3, and the words on the sleeve 14 and in the next position to those previously visible will become visible through the window 24. At the same time the outlet aperture 23 in the cover 18 will be closed by the upper face of the retainer insert 7.

Thus in the particular embodiment, where the legend TUE AM was previously visible through the window 24, the legend TUE PM will now become visible.

By this means a user will be able to check that a dose prescribed for one time has been dispensed and to confirm when the next dose is due to be dispensed.

It will be understood that, although the invention has been described, by way of example, with reference to a particular embodiment, variations and modifications may be made within the scope of the invention. For example, the invention could be employed to indicate when a container had last been opened, when it should next be opened or both. The contents of a container with which the indicator device is used need not be tablets, the contents may, for example, be a liquid, or in powder form. It will also be understood that the particular shapes of the parts may be different from those shown. In the particular embodiment described, the arcuate slot 22 provides a visual indication of the direction and extent of the turn necessary to operate the device, in addition to limiting the amount of the rotation. The slot 22 may be omitted, the amount of rotation being limited by other means provided, for example, within the cover 18, and instructions may be provided on the cover relating to the direction and amount of rotation. It would also be possible to arrange the angular rotation of the rotatable element to be of some value other than 1/14th of a turn and it could be that the outer cover remains stationary relative to a container and that an inner member is rotated by means of a projecting member. It will also be understood, for example, that spring means may be incorporated to cause the cover 18 to return in the clockwise direction and maintain the cap closed in the normal position.

What I claim is:

1. An indicator device having a first cylindrical rotatable member, an aperture defined by the first member, a second cylindrical rotatable member arranged concentrically with respect to the first member, a third cylindrical member, the third cylindrical member being concentric with the first and second members, means coupling the first and second members for rotation together in a first direction of rotation from a first position of the first member in which access through the aperture is not possible to a second position of the first member in which access through the aperture is possible, means coupling the second and third members to prevent the rotation of the second member in the direction of rotation opposite to the first direction during the rotation of the first member from the second position to the first position and means to indicate the restoration of the first member to its first position after it has been rotated to the second position.

2. An indicator device as claimed in claim 1 in which the second cylindrical member is arranged between the first and third cylindrical members.

3. An indicator device as claimed in claim 1 including first ratchet and pawl means coupling the first and second cylindrical members for rotation together in the first direction and second ratchet and pawl means coupling the second and third members together against rotation of the second member in the direction opposite to the first direction.

4. An indicator device as claimed in claim 1 including an end face on the first cylindrical member, the end face defining the aperture.

5. An indicator device as claimed in claim 1 including a second aperture defined by the first member, and markings on the second cylindrical member, the second aperture enabling a marking on the second cylindrical member to be disclosed to indicate the restoration of the first member.

* * * * *